United States Patent [19]

Koike

[11] Patent Number: 4,979,837

[45] Date of Patent: Dec. 25, 1990

[54] PAPER TRACTOR

[75] Inventor: Yasushi Koike, Tokyo, Japan

[73] Assignee: Seikosha Co., Ltd., Japan

[21] Appl. No.: 520,841

[22] Filed: May 7, 1990

Related U.S. Application Data

[63] Continuation of Ser. No. 198,127, May 24, 1988, abandoned.

[30] Foreign Application Priority Data

Jun. 17, 1987 [JP] Japan ..... 62-150564

[51] Int. Cl.[5] ..... B41J 11/28

[52] U.S. Cl. ..... 400/616.1; 226/76

[58] Field of Search ..... 400/616, 616.1, 616.2, 400/616.3; 226/74–86

[56] References Cited

U.S. PATENT DOCUMENTS

| | | | |
|---|---|---|---|
| 3,283,875 | 11/1966 | Davies | 400/616.1 |
| 3,583,539 | 6/1971 | Shellabarger | 400/616 |
| 3,693,856 | 9/1972 | Funk | 226/79 X |
| 4,189,078 | 2/1980 | Spisz | 226/74 |
| 4,304,345 | 12/1981 | Carlin | 226/74 |
| 4,315,585 | 2/1982 | Seitz | 226/74 |
| 4,344,715 | 8/1982 | Van Horne et al. | 226/74 X |
| 4,365,905 | 12/1982 | Jung | 400/616.2 |
| 4,389,007 | 6/1983 | Seitz | 226/74 |
| 4,394,949 | 7/1983 | Gomi | 226/82 X |
| 4,471,896 | 9/1984 | Milano, Jr. | 226/74 |
| 4,637,537 | 1/1987 | Ikeda | 400/616.3 X |

FOREIGN PATENT DOCUMENTS

| | | | |
|---|---|---|---|
| 3212988 | 11/1982 | Fed. Rep. of Germany | 400/616.1 |
| 0002043 | 1/1980 | Japan | 400/616.1 |
| 0172763 | 8/1986 | Japan | 400/616.1 |
| 0042864 | 2/1987 | Japan | 400/616.1 |
| 0082058 | 4/1987 | Japan | 400/616 |

OTHER PUBLICATIONS

IBM Technical Disclosure Bulletin, "Tractor Clamp Device Cam Lock", Williams, vol. 19, No. 11, Apr. 1977, pp. 4114–4115.

*Primary Examiner*—Edgar S. Burr
*Assistant Examiner*—Moshe I. Cohen
*Attorney, Agent, or Firm*—Bruce L. Adams; Van C. Wilks

[57] ABSTRACT

A paper tractor comprising a driven sprocket wheel engaging recording paper to feed same, a chassis holding the sprocket wheel on its both sides and movable widthwise of recording paper, a fixed member supporting the chassis slidably via an engaging portion formed at one end thereof and extending widthwise of the recording paper, and a locking lever provided swingable at one end of the chassis and having a locking cam engageable with part of the fixed member. The locking cam including a first cam face for restricting the movement of the chassis by engaging part of the fixed member when the locking lever is swung to a locking position, and a second cam face for allowing the chassis to move opposite to part of the fixed member in virtually non-engaged relationship thereto when the locking lever is swung to its released position.

14 Claims, 4 Drawing Sheets

PAPER TRACTOR

This is a Rule 62 continuation application of patent application Ser. No. 198,127 filed May 24, 1988, now abandoned.

FIELD OF THE INVENTION

This invention relates to a paper tractor which carries recording paper in a printer and in particular to a slidable paper tractor having cam locking means.

BACKGROUND OF THE INVENTION

Generally, there are two types of such paper tractors, one being a sprocket wheel type and another being a sprocket belt type. In these tractors, a plurality of sprockets formed on the outer periphery of a sprocket wheel or a sprocket belt are arranged to engage perforations formed in the sides of recording paper. The recording paper is carried by rotating the sprocket wheel or sprocket belt to thereby rotate the respective sprockets sequentially.

The sprocket wheel or sprocket belt is accommodated in the chassis provided with an openable paper hold cover. It is provided movable along its drive shaft or support shaft integrally with the chassis in accordance with the width of the recording paper. It can be fixed at a desired position by a fixing device provided on the chassis. Conventional fixing means is disclosed, for example, in U.S. Pat. No. 4,315,585 in which a protrusion having a circular arc-like cross section extends from a fitting hole for the support shaft 26 formed in the chassis. Fitted to the protrusion is a fixing lever 16 in which the inner peripheral surfaces 66 receive the protrusion 40 and the fixing lever and protrusion are arranged to be eccentric with each other relative to the support shaft. When the fixing lever is swung in one direction, the respective inner peripheral surfaces are pressed against and engaged with the support shaft to thereby fix the chassis at a desired position while when the fixing lever is swung in another direction the engagement is released for axial movement of the chassis along the support shaft.

According to the conventional fixing apparatus, the chassis and fixing lever have a complicated configuration, and the support shaft and many parts must be provided, so that the manufacturing takes much time, the cost is high and miniaturization and lightening are hindered.

It is therefore an object of this invention to simplify the structure, render manufacturing easy, reduce the manufacturing cost and achieve miniaturization and lightening.

This invention is characterized by a paper tractor comprising; a driven shaft rotated when paper is fed; a rotary member not rotatable relative to the driven shaft and fitted to and slidable along the driven shaft; a plurality of sprockets provided engageable with respective perforations in recording paper and fed sequentially in the direction of rotation of the rotary member as the rotary member rotates; a chassis holding the rotary member on its both sides and movable widthwise of the recording paper; a fixed member supporting the chassis slidably via an engaging portion formed at one end of the chassis and extending widthwise of the recording paper; and a locking lever provided swingable at one end of the chassis, wherein the locking lever has a locking cam engageable with part of the fixed member, the locking cam including a first cam face for restricting the movement of the chassis by engaging part of the fixed member when the locking lever is swung to a locking position, and a second cam face for allowing the chassis to move relative to the fixed member in virtually non-engaged relationship thereto when the locking lever is swung to its released position.

When the locking lever is swung to a locking position, the first cam face of the locking cam provided on the locking lever is engaged with part of the fixed member to restrict the movement of the chassis and when the locking lever is swung to a release position, the second cam face of the locking cam opposes the fixed member in non-engaged relationship thereto to thereby allow the chassis to move widthwise of the recording paper.

BRIEF DESCRIPTION OF THE DRAWINGS

The drawings show one embodiment of this invention.

BRIEF DESCRIPTION OF THE PREFERRED EMBODIMENTS

One embodiment of this invention will now be described with reference to the drawings.

Figure 1:
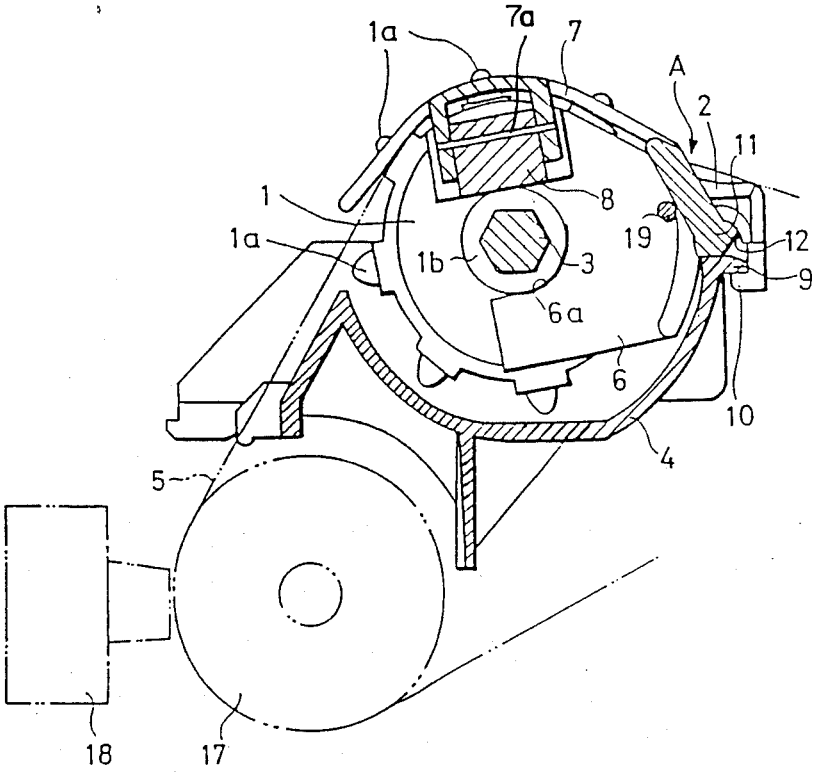
FIG. 1 is a side cross section view of the embodiment.
Figure 2:
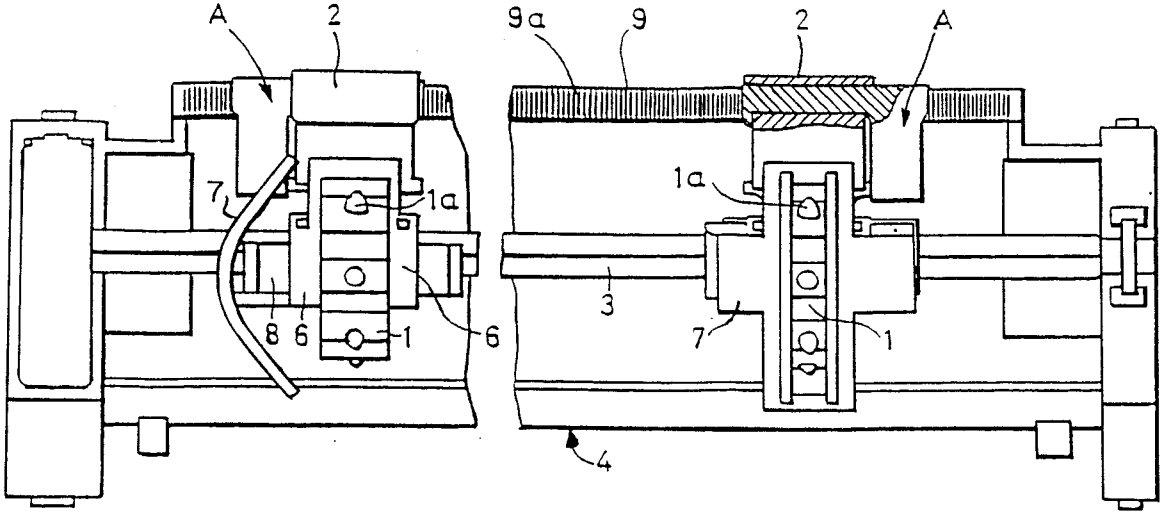
FIG. 2 is a partially cutaway front view.

As shown in FIGS. 1 and 2, the paper tractor has a pair of right and left sets of sprocket wheels 1 as a rotary member and a chassis 2 which accommodates sprocket wheels 1. A driven shaft 3 is rotatably supported by a support frame 4 as a fixed member. Sprocket wheel 1 is fitted to the driven shaft 3 so as to be not rotatable relative to the shaft 3 but slidable along the shaft 3. Sprocket wheel 1 is movable widthwise of the recording paper 5 along driven shaft 3 together with chassis 2. A plurality of sprockets 1*a* are formed at equal intervals around the outer periphery of sprocket wheel 1. Respective sprockets 1*a* are engageable with perforations (not shown) formed in the side of the recording paper 5 and are fed sequentially in the direction of rotation of the wheel 1 as the wheel 1 rotates to thereby carry the recording paper 5. The chassis 2 has a pair of opposing arms 6 disposed at a predetermined spacing. The arms 6 hold sprocket wheel 1 on its both sides. Arm 6 has a substantially U-like groove 6*a* in its front end with a sleeve 1*b* of sprocket wheel 1 being fitted rotatably in the groove 6*a*. A resilient protrusion is provided on the side of chassis 2. The protrusion 8 pivotally supports a paper hold cover 7 on pivot 7*a* which snaps into opened and closed positions by the resiliency of resilient protrusion 8. A rail-like portion 9 extending widthwise of the recording paper 5 is formed integrally with the upper rear edge of support frame 4 and a substantially L-like engaging member 10 formed at the rear end of chassis 2 is engaged with rail-like portion 9 so as to be movable widthwise of the recording paper. Knurlings 9*a* are formed transversely on the upper surface of rail-like portion 9.

Figure 3:
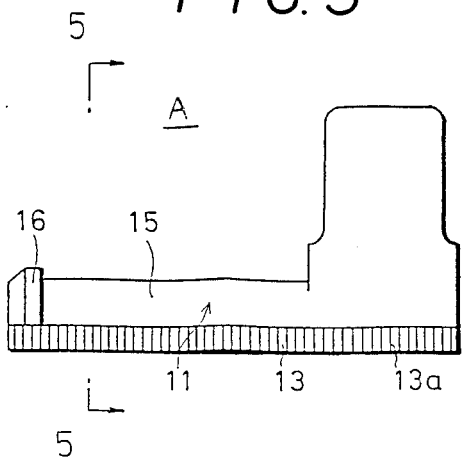
FIG. 3 is an enlarged front view of a locking lever.
Figure 4:
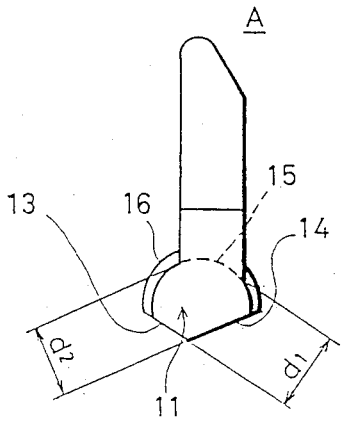
FIG. 4 is an enlarged right-hand side view of the locking lever.
Figure 5:
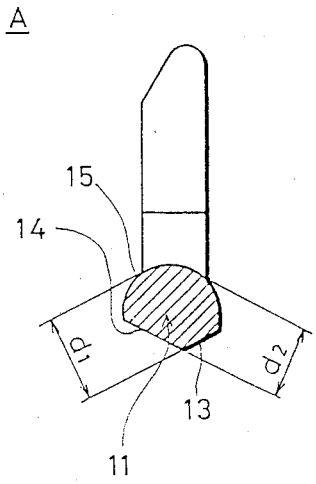
FIG. 5 is a cross section view taken along the line 5—5 of FIG. 3.

A locking lever A is provided swingably at the rear end of chassis 2. As shown in FIG. 3, the locking lever A has a locking cam 11 having a sectral cross sectional form. The locking cam 11 is fitted rotatably in the space S (shown in FIGS. 1, 7–9) defined by rail-like portion 9 and a recess 12 defining a fixed cam surface having a circular arc-like inner peripheral surface provided at the rear end of chassis 2 and rail-like portion 9. As shown in FIGS. 4 and 5, the locking cam 11 has a first or stop cam face 13 and a second or flat cam face 14 respectively which are formed such that d1 is the distance between the first cam face 13 and the circular-arc curved surface 15 (FIG. 3) of locking cam 11 and d2 is the distance between the second cam face 14 and the curved surface 15. The first cam face 13 has a knurling 13*a* (shown in FIG. 3) perpendicular to the longitudinal axis thereof. The distance between the inner peripheral surface of the recess 12 forming the space S (FIGS. 1, 7–9) into which the locking cam 11 fits and the upper surface of rail-like portion 9 is set to be equal to, or slightly shorter than, the distance d1 between the first cam 13 and curved face 15, and to be slightly longer than the distance d2 between the second cam face 14 and curved surface 15.

A protrusion 16 (shown in FIG. 3) engages the end edge of recess 12 to prevent locking lever A from being disengaged. In FIG. 1, reference numerals 17, 18 and 19 denote a platen, a printing head and a position restricting pin which restricts the swing range of the locking lever A.

The operation will now be described.

Figure 6:
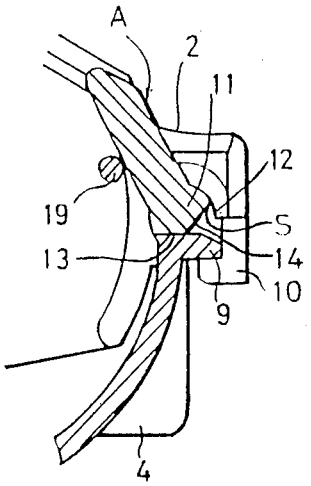
FIGS. 6 and 7 are enlarged cross section views of the essential portion of the embodiment showing the state in which the locking lever is swung to its locked position.
Figure 7:
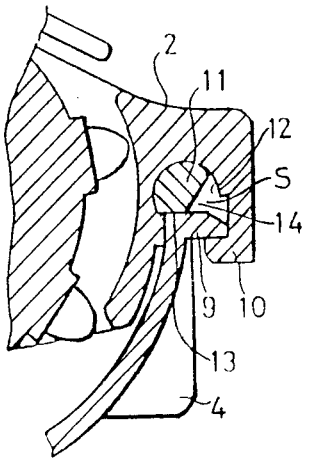

As shown in FIGS. 6 and 7, when the locking lever A is swung to the locking position, the curved face 15 of locking cam 11 provided on the locking lever A is engaged with the inner peripheral surface of the recess 12, and the first cam face 13 is engaged with the upper surface of rail-like portion 9. Therefore, the chassis 2 is restricted from moving by the first cam face 13 and the upper surface of rail-like portion 9. In this embodiment, knurlings 13*a* and 9*a* are formed on the first cam face 13 and the upper surface of rail-like portion 9, respectively, so that restriction to the movement of chassis 2 is ensured.

Figure 8:
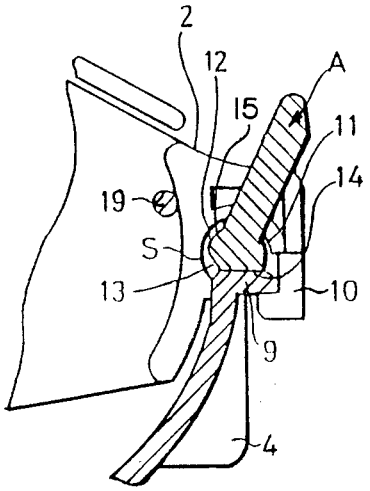
FIGS. 8 and 9 are enlarged cross section views showing the state in which the locking lever is swung to its release position.
Figure 9:
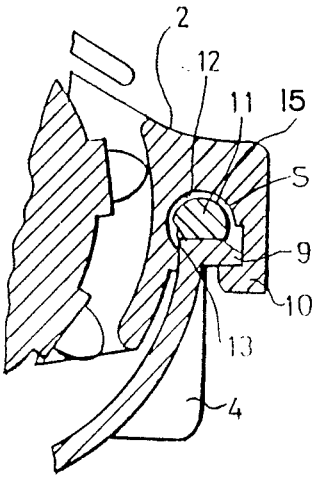

As shown in FIGS. 8 and 9, when locking lever A is swung to its release position, the curved surface 15 of locking cam 11 disengages from the inner peripheral surface of recess 12 opposite the second cam face 14 which, in turn, is in substantially non-engaged relationship to the upper surface of the rail-like portion 9 so that the chassis 2 is displacable widthwise of recording paper 6.

In order to set recording paper 5, first, the locking lever A is swung to its release position, as shown in FIGS. 8 and 9, chassis 2 is rendered movable and moved to a desired position corresponding to the width of recording paper 5. Thereafter, sprockets 1*a* of sprocket wheel 1 are fitted into perforations (not shown) in recording paper 5, paper hold cover 7 is then closed, and locking lever A is swung to its locked position, as shown in FIGS. 6 and 7. Chassis 2 is then fixed surely and recording paper 5 is set completely.

While this embodiment is applied to the sprocket type in which protruding sprockets 1*a* are provided on the outer surface of sprocket wheel 1, this invention includes wheel 1 as a belt driving wheel and the endless belt driven by this driving wheel 1 and having sprockets formed thereon. In that case, if, as disclosed in Japanese Laid-Open Patent Application No. 82058/1987, the belt driving wheel 1 (rotary member) around which the sprocket bearing belt is wound is fitted to the driven shaft 3 and a follower wheel is supported rotatably by chassis 2, the support shaft may be removed as in the above embodiment.

While the above embodiment shows an example wherein the inner peripheral surface of the recess 12 and the curved surface 15 of the locking cam 11 are formed circular arc-like, and the relationship $d1 > d2$ is satisfied where d1 is the distance between the first cam face 13 and curved surface 15 and d2 is the distance between the second cam face 14 and curved surface 15, the shape of recess 12 and locking cam 11 is not limited to it. Arrangement is only required to be such that when the locking lever A is swung to its locked position, the first cam face 13 is engaged with part (rail-like portion) 9 of fixed member (support frame) 4 to thereby restrict the movement of the chassis 2 and when locking lever A is swung to its release position, the second cam face 14 opposes part (rail-like portion) 9 of fixed member (support frame) 4 in substantially non-engaged relationship thereto to allow chassis 2 to move. For example, one or both of the inner peripheral surface of recess 12 and the curved surface 15 of locking cam 11 may be formed as an eccentric surface or the distance between each of the cam faces 13 and 14 and the curved surface 15 of locking cam 11 may be selectable properly depending on the shape of the inner peripheral surface of recess 12 and the curved surface 15 of locking cam 11. While the above embodiment shows a structure in which the locking cam 11 is fitted rotatably into the space formed between the recess 12 having the circular arc-like inner peripheral surface formed at the rear end of chassis 2 and part (rail-like portion 9) of fixed member (support frame) 4, the arrangement may be such that locking lever A is supported rotatably in an axial hole provided in the rear end of chassis 2, locking cam 11 is formed only at a lower end of a lever portion of locking lever A and the distance from the swing center of first cam face 13 is longer than the distance from a swing center of second cam face 14.

As described above in detail, according to this invention, the swingable locking lever is provided at one end of the chassis and has the locking cam engageable with part of the fixed member, and the locking cam has a first and a second cam face. When the locking lever is swung to its locked position, the first cam face is engaged with part of the fixed member to thereby fix the position of the chassis. When the locking lever is swung to its release position, the second cam face opposes part of the fixed member in substantially non-engaged relationship thereto to thereby allow the chassis to move. Therefore, the structure is very simple, manufacturing is easy, the manufacturing cost is reduced and miniaturization and lightening are achieved.

What is claimed is:

1. A slidable paper tractor mechanism comprising:

a fixed member slidably engaged by a paper tractor element to permit said tractor element to move back and forth laterally of the paper;

a fixed cam surface adjacent said tractor element;

a locking arm pivotally mounted adjacent said fixed cam surface on a pivot axis and having a locking cam surface comprising a first cam face engageable with said fixed cam surface in one position of said locking arm and disengaged therefrom in a second position of said locking arm, and a stop cam face engageable with said fixed member when said locking arm is in said one position, whereby said tractor element may be locked and unlocked relative to said fixed member;

wherein the pivot axis of said locking arm is eccentrically located relative to said fixed cam surface whereby movement of said locking arm between said one and said second positions causes said first cam face to move respectively into and out of engagement with said fixed cam surface; and wherein said stop cam face is formed on one side of said pivot axis and said locking cam surface includes a flat formed on the opposite side of said pivot axis from said stop cam face, said flat being positioned to slide over said fixed member when said locking arm is in said second position.

2. The tractor mechanism of claim 1 in which said fixed cam surface and said locking arm are each carried by said tractor element.

3. The tractor mechanism of claim 1 in which said fixed cam surface overlies said first cam face of said locking arm.

4. The tractor mechanism of claim 3 in which said fixed cam surface and said first cam face of said locking arm are substantially concentrically positioned relative to each other.

5. The tractor mechanism of claim 1 in which the cross sectional distance from said stop cam face to said first cam face of said locking arm is greater than the cross sectional distance of said flat to said first cam face.

6. The tractor mechanism of claim 5 in which said fixed cam surface is substantially semi-circular in cross section and has a longitudinal axis substantially parallel to said fixed member.

7. The tractor mechanism of claim 6 wherein the cross sectional distance from said fixed member to said first cam face of said locking arm is less than the cross sectional distance from said fixed member to said fixed cam surface.

8. The tractor mechanism of claim 1 in which said locking arm comprises mutually normal segments, one of said segments being substantially longitudinally coextensive with said fixed cam surface and the other of said segments consisting of a tactile portion configured to be gripped by the user.

9. A paper tractor comprising:

a drive shaft, a stationary member for rotatably supporting the drive shaft and having an extending portion integrally formed therewith and extending parallel to the drive shaft, wherein the extending portion has knurlings on a surface thereof, a rotary member mounted for rotation with the drive shaft and for slidable movement therealong and having a plurality of sprockets on a periphery thereof for feeding paper, a movable chassis supporting the rotary member for movement therewith and having a part slidably engaged with the extending portion of the stationary member and means forming a recess at a portion adjacent the extending portion and having an inner surface, a locking lever having a cam portion pivotally mounted in the recess in the chassis adjacent to the extending portion for movement into a locking position and an unlocking position, and wherein the cam portion has a cam face having knurlings engageable with the knurlings on the extending portion when the cam portion is in the locking position to restrict movement of the chassis and disengageable therefrom when the cam portion is in the unlocking position and a stop face engageable with an inner surface of the recess when the locking lever is in the locking position, whereby the chassis can be locked and unlocked relative to the stationary member.

10. A paper tractor according to claim 9, wherein the cam portion has a substantially sectorial cross section.

11. A paper tractor according to claim 9, wherein the recess has a circular arc shape.

12. A paper tractor according to claim 9, wherein the cam portion has a protrusion at an end thereof engaged with an edge of the recess when in the locking position for preventing disengagement of the locking lever.

13. A paper tractor according to claim 9, wherein the stop face is formed on one side of the cam portion and the cam face includes a flat portion formed on an opposite side of the cam portion from the stop face, wherein the flat portion is configured to slide over the knurlings when the cam portion is in the unlocking position.

14. A paper tractor according to claim 13, wherein the stop face has a cross sectional distance to the cam face which is greater than a cross sectional distance from the stop face to the flat portion.

* * * * *